US007091919B2

(12) United States Patent
Bannon

(10) Patent No.: US 7,091,919 B2
(45) Date of Patent: Aug. 15, 2006

(54) APPARATUS AND METHOD TO INCREASE APPARENT RESONANT SLOT LENGTH IN A SLOTTED COAXIAL ANTENNA

(75) Inventor: Walter W. Bannon, Bridgton, ME (US)

(73) Assignee: SPX Corporation, Charlotte, NC (US)

( * ) Notice: Subject to any disclaimer, the term of this patent is extended or adjusted under 35 U.S.C. 154(b) by 56 days.

(21) Appl. No.: 10/747,159

(22) Filed: Dec. 30, 2003

(65) Prior Publication Data

US 2005/0146474 A1 Jul. 7, 2005

(51) Int. Cl.
*H01Q 13/10* (2006.01)

(52) U.S. Cl. ..... 343/768; 343/770

(58) Field of Classification Search ..... 343/767–768, 343/770–771, 850, 904–906
See application file for complete search history.

(56) References Cited

U.S. PATENT DOCUMENTS 2,981,947 A * 4/1961 Bazan ..... 343/767
3,795,915 A * 3/1974 Yoshida ..... 343/771
4,129,871 A * 12/1978 Johns ..... 343/727
4,583,098 A * 4/1986 Sikina, Jr. ..... 343/771
4,590,480 A * 5/1986 Nikolayuk et al. ..... 343/771
4,907,008 A * 3/1990 Dienes ..... 343/727
5,546,096 A * 8/1996 Wada ..... 343/771
5,705,967 A * 1/1998 Pirard ..... 333/237
5,809,429 A * 9/1998 Knop et al. ..... 455/523
6,703,984 B1 * 3/2004 Schadler ..... 343/770
6,867,743 B1 * 3/2005 Schadler ..... 343/767
2002/0126060 A1 * 9/2002 Schadler ..... 343/770

* cited by examiner

*Primary Examiner*—Thuy Vinh Tran
(74) *Attorney, Agent, or Firm*—Baker & Hostetler LLP

(57) ABSTRACT

An oblique angle defining the slot face opposing a coupler in a slotted coaxial antenna increases the apparent slot length and therewith the capacitance of the driven element. The altered slot angle, in concert with a flattened facing surface on the associated coupler, increases the radiating efficiency of the antenna.

27 Claims, 8 Drawing Sheets

PRIOR ART

PRIOR ART

PRIOR ART

APPARATUS AND METHOD TO INCREASE APPARENT RESONANT SLOT LENGTH IN A SLOTTED COAXIAL ANTENNA

FIELD OF THE INVENTION

The present invention relates generally to antennas. More particularly, the present invention relates to resonant-slotted coaxial antennas.

BACKGROUND OF THE INVENTION

Coaxial transmission lines carrying radio frequency (RF) energy can be used as antennas provided the center conductor of the coaxial line couples RF energy to an aperture in the outer conductor, termed a slot, with sufficient efficiency to cause emission of a significant proportion of the energy applied to the slotted coax/antenna. A typical slotted coaxial line antenna designed for ultra-high frequency (UHF) broadcast, for example, may have from about four to several dozen slots in line, typically occurring at one-wavelength intervals. Such an antenna may also have more than one radially-disposed set of slots.

In order for the slotted coax to radiate efficiently, the two sides of the slot should have a differential distance to the center conductor. This is commonly realized by affixing a conductive rod parallel to the center conductor near or adjacent to one edge of the slot. The impedance mismatch induced by the rod tends to promote radiation out the slot.

Various modifications of the basic concept of the slotted coax antenna and the tradeoffs associated therewith have been attempted by many practitioners of slotted coax design. For instance, it is known that increasing the length of each slot to a full wavelength can be electrically beneficial—but produces a structure with one or more continuous slots, which compromises the mechanical integrity of the antenna. Enlarging the size of each slot near the ends to form a shape known in the art as a "dog bone" can increase the perimeter length while preserving the capacitance at the center of the slot, improving radiation performance but incurring other drawbacks. Inserting a block of higher-dielectric-constant material, such as polytetrafluoroethylene (PTFE, sold for example under the trade name Teflon®) in the slot can reduce the slot's electrical width, but can promote contamination and arcing during extended use. Increasing antenna outer conductor diameter allows the slots to be shorter, but may increase weight and wind drag.

Accordingly, it is desirable to provide an apparatus and method for a slotted coax antenna that increases overall performance with minimal deleterious effects.

SUMMARY OF THE INVENTION

The foregoing needs are met, to a great extent, by the present invention, wherein in one aspect a slotted coax antenna is provided that in some embodiments incorporates a parallel-sided slot, each of whose sides lies in a plane parallel to the coax longitudinal axis, but whose slot center plane does not include the coax longitudinal axis. That is, the parallel-sided slot is tilted rather than radially-oriented with respect to the coax longitudinal axis. The number of slots may be any number, limited by structural considerations and performance needs. The effect of this invention is to increase the capacitance of the slot compared to previous designs while reducing penalties of decreased voltage capability, bandwidth, and structural strength.

In accordance with one embodiment of the present invention, a slotted coaxial antenna comprises a section of coaxial signal line capable of conducting radio-frequency electromagnetic signals, an outer conductor of the coaxial signal line section, an inner conductor of the coaxial signal line section, a longitudinal axis of the coaxial signal line, a first slot in the coaxial signal line wherein a first planar region of the first slot is situated obliquely to a radial projection from the longitudinal axis of the coaxial signal line projected through the center of the slot, and a first coupler with a long axis thereof extending parallel to the longitudinal axis of the coaxial signal line, wherein the first coupler is positioned proximally to the first slot.

In accordance with another embodiment of the present invention, a slotted coaxial antenna comprises conducting means for conducting a radio frequency signal, confining means for confining the conducted radio frequency signal within a closed, electrically conductive boundary, allowing means for allowing a portion of the radio frequency signal to be emitted from within the closed, electrically conductive boundary, coupling means for coupling the allowed portion of the radio frequency signal into a condition for emission; and tilting means for tilting and extending the effective physical dimensions of the allowing means.

In accordance with yet another embodiment of the present invention, a process for emitting radio frequency signals comprises the steps of conducting a radio frequency signal, confining the conducted radio frequency signal within a closed, electrically conductive boundary, allowing a portion of the radio frequency signal to be emitted from within the closed, electrically conductive boundary, coupling the allowed portion of the radio frequency signal into a condition for emission; and tilting and extending the effective physical dimensions of the allowing step.

There have thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
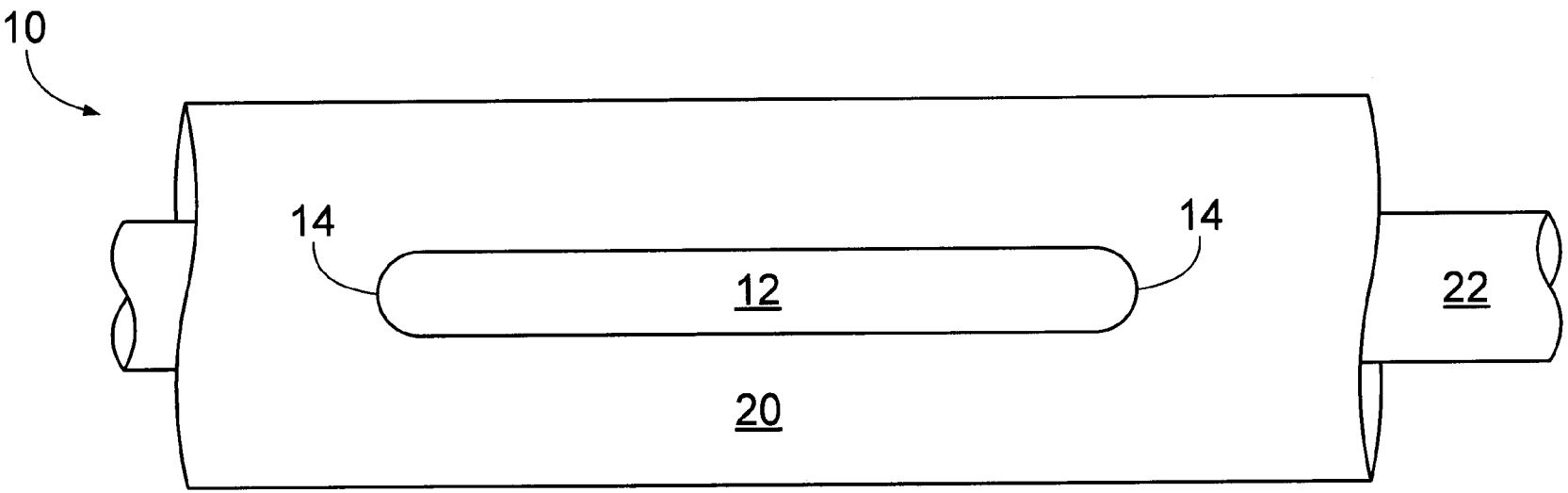
FIG. 1 PRIOR ART
FIG. 1 is a view illustrating a slotted coaxial line according to the prior art.

The invention will now be described with reference to the drawing figures, in which like reference numerals refer to like parts throughout. An embodiment in accordance with the present invention provides increased slot capacitance while largely preserving other performance aspects in a slotted-coax antenna.

FIG. 1 illustrates a section of a prior-art coax 10 with a generic resonant slot 12 in the outer conductor, used as a radiating aperture. The long axis of the slot 12 is oriented parallel to the axis of the coax 10 of the ends 14 of the slot 12 are rounded to minimize voltage gradients.

Referring to FIG. 1, the tradeoffs in providing an antenna with larger outer and inner coax diameters correlate to a great extent with the penalties in weight and wind drag. If the outer conductor 20 inner diameter is doubled, for example, while the outer conductor 20 thickness is maintained constant, then the weight of the outer conductor 20 approximately doubles, while the wind loading due to conductor size likewise roughly doubles, both of which factors can increase the structural loading on a broadcast tower. To maintain constant impedance, both outer conductor 20 inner diameter and inner conductor 22 outer diameter are required to increase at the same rate, assuming an unchanged dielectric constant. Increasing the inner conductor 22 outside surface area decreases RF current density, allowing a higher-power signal to be transmitted through the coax without overloading the power capability thereof, and allows an increased number of slots 12 to be used, since there is more non-slot structure to support an increased number of circumferentially disposed slots 12.

Figure 2:
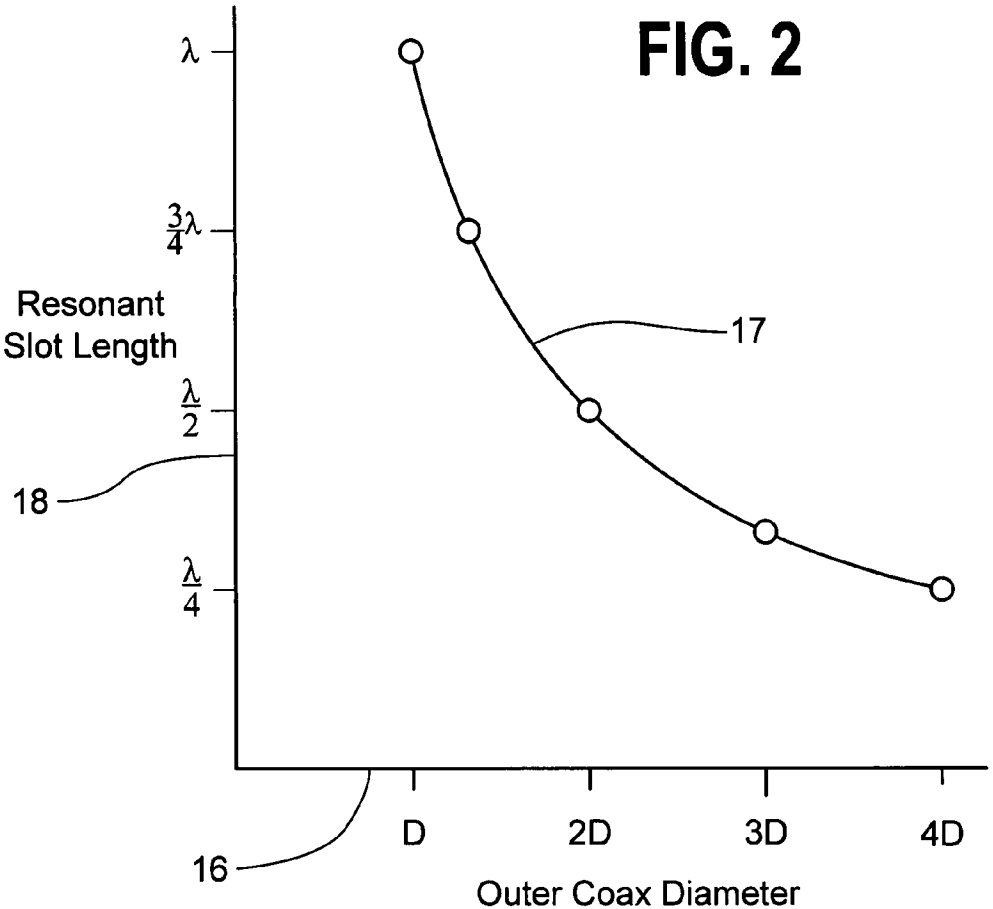
FIG. 2 PRIOR ART
FIG. 2 is a chart showing the relationship between coax diameter and slot length.

FIG. 2 is a graph illustrating the inverse relationship 17 between coax diameter 16 in wavelengths and minimum effective slot length 18 in wavelengths. As demonstrated in FIG. 2, a larger-diameter coax outer conductor 16 radiates more efficiently with a shorter slot 18. However, a small diameter for the coax is desirable in order to minimize material and fabrication cost, weight, and wind drag.

Figure 3:
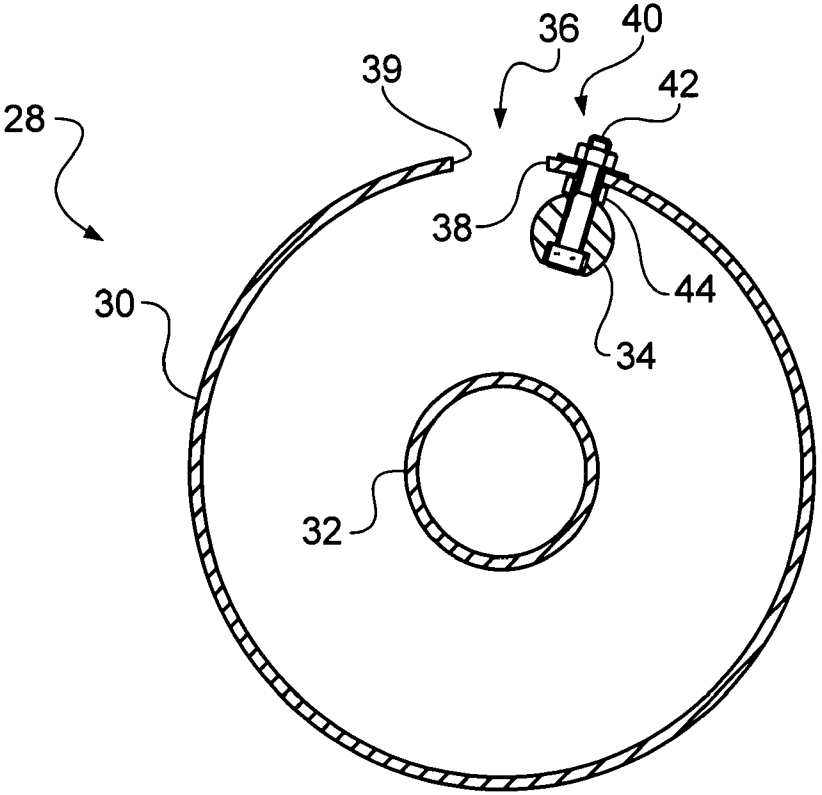
FIG. 3 is a section view illustrating a representative prior-art slotted coaxial line antenna.

FIG. 3 shows a cross section view of a prior-art single-slot antenna 28. An outer conductor 30 and an inner conductor 32 comprise the coaxial line. A conductive-surfaced block functions as a coupler 34 to establish the conditions for radiation from a slot 36. The coupler 34 is attached to the outer conductor 30 at a first wall 38 of the slot 36, opposite a second wall 39, using mounting hardware 40 that maintains electrical continuity between the outer conductor 30 and the coupler 34. The mounting hardware 40 typically comprises a bolt-and-nut fastening 42 and a spacer 44. The coupler 34 may be mounted at any distance from the outer conductor 30 that can be shown to promote efficient RF emission at a selected frequency. In general, the closer the coupler 34 is positioned to the inner conductor 32, the higher the signal level and the greater the emission will be at that slot 36. This can result in an association between the total number of slots 36 in the antenna 28 and the closeness of the coupler 34 to the inner conductor 32.

Figure 4:
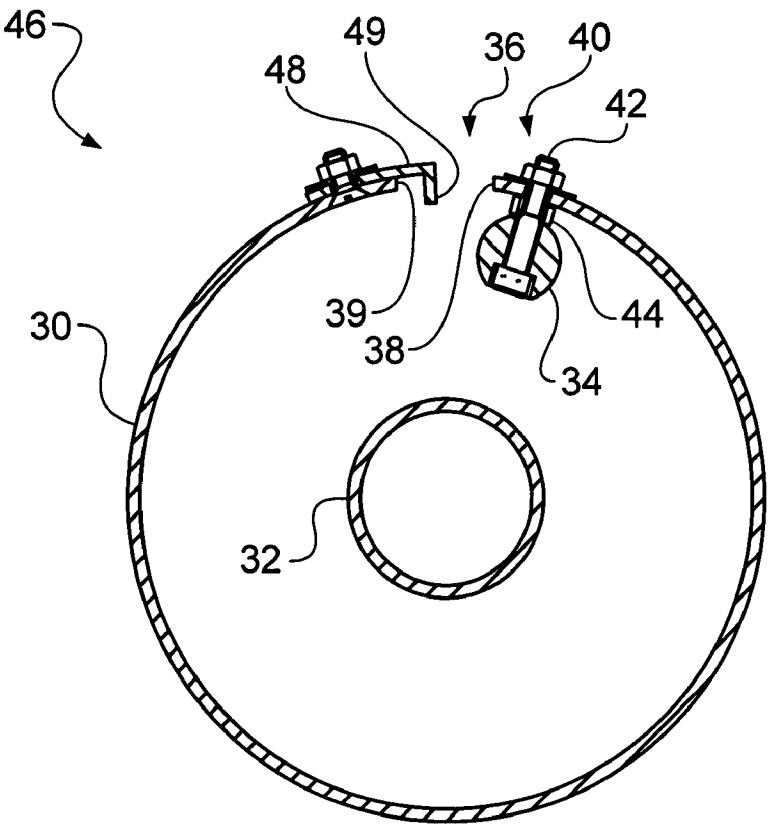
FIG. 4 is a section view of a prior-art slotted coaxial line antenna with a slot extender.

FIG. 4 shows a cross section view of another prior art antenna 46. This is substantially identical to the design of FIG. 3, with the addition of a device known in the art as a slot extender 48, attached at the second wall 39, opposite the coupler 34. The extended lip 49 of the slot extender 48 reduces the effective width of the slot 36, increasing capacitance and thus radiation efficiency. The slot extender 48 adds an additional unit of hardware that requires adjustment and can exhibit a tendency to lose electrical continuity, and thus effectiveness, over time, when subjected to climate variations, for example. However, the reduced interelectrode spacing caused by the slot extender 48 increases the possibility of arcing, and thus can limit allowable peak transmitted power.

Figure 5:
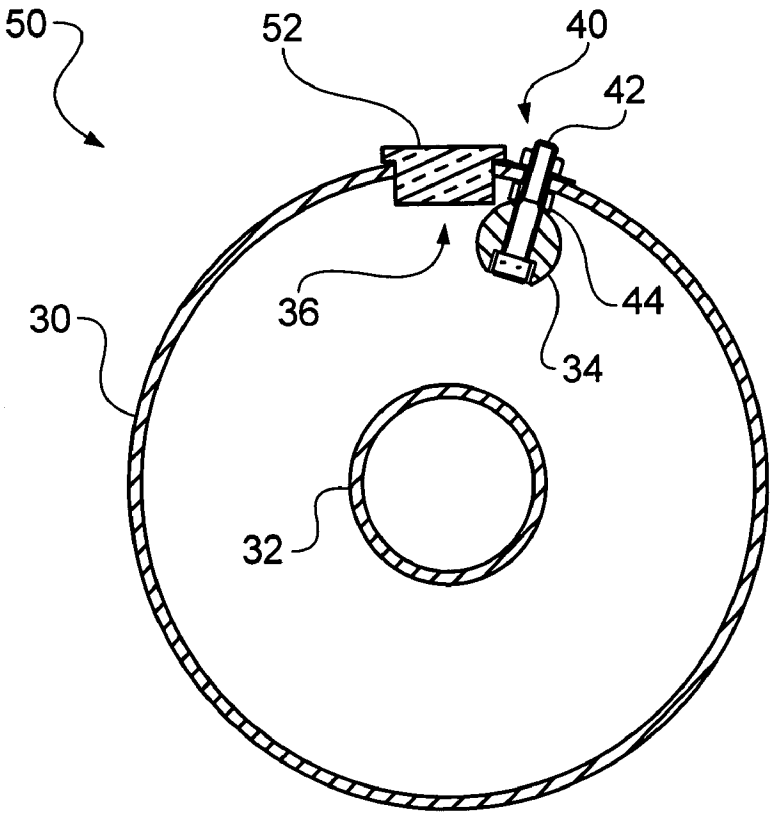
FIG. 5 is a section view of a prior-art slotted coaxial line antenna with a dielectric insert.

FIG. 5 shows yet another cross section view of a prior art antenna 50. This is also substantially identical to the design of FIG. 3, with the addition of a dielectric insert 52. The insert 52 increases capacitance, which can be beneficial, but provides a surface connecting the walls of the slot 36 that can accumulate dirt, moisture, and other contaminants. This accumulation of contaminants can, over time, establish a conductive path across the slot gap, and can lead to gradual performance deterioration.

Figure 6:
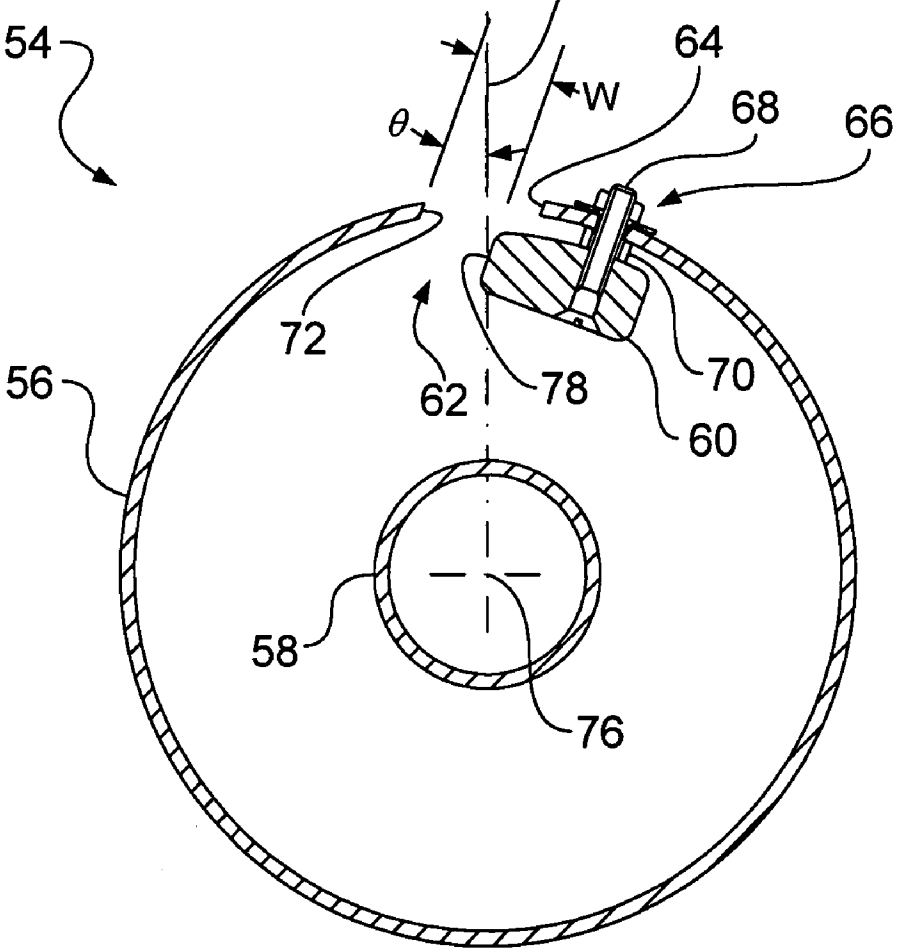
FIG. 6 is a section view of an exemplary slotted coaxial line antenna incorporating the preferred embodiment of the invention.

FIG. 6 shows a cross section view of an exemplary single-slot antenna 54 according to this invention. The exemplary single-slot antenna 54 comprises an outer conductor 56 and an inner conductor 58, a coupler 60, and a non-radially-edged slot 62. A conductive-surfaced coupler 60 helps to establish the conditions for radiation from a slot 62. The coupler 60 is attached to the outer conductor 56 near a first wall 64 of the slot 62 using mounting hardware 66 that maintains electrical continuity between the outer conductor 56 and the coupler 60. The mounting hardware 66 is shown as comprising a bolt-washer-and-nut fastening 68 and a spacer 70. However, other forms of mounting may be used, as desired. The coupler 60 may be mounted at any location between the inner 56 and outer 58 conductors; experimentation may identify an optimum position for efficient RF emission at a selected frequency. Where preferred performance so dictates, the spacer 70 may not be required.

The second wall 72 of the slot 62 may be spaced away from the first wall 64 by a distance determined by the voltage level of the broadcast signal and as a function of the transmitting frequency. The second wall 72 in the exemplary embodiment 54 of FIG. 6 is oriented at an angle to a radial projection 74 from the centerline 76 of the coax through the center of the slot, rather than parallel to that projection 74. The exemplary coupler 60 may not be cylindrical as in some prior art designs, but may have, for example, a flat surface 78 parallel to the second wall 72, establishing thereby an effective slot width W.

The presence of parallel surfaces 72 and 78 of the slot 62 increases the surface area and accordingly the effective width of the slot 62, and thus the capacitance and radiating efficiency of the slot 62. The positioning of the walls of the slot 62 at an angle θ, by causing the outer conductor 56 material to be cut obliquely, can similarly increase the slot surface area without intruding additional material into the coax, adding external flanges, or thickening the material from which the outer conductor 56 is formed.

The magnitude of the angle θ may vary according to the dimensions of the elements making up the antenna 54, and of the frequency and bandwidth characterizing the signal to be radiated by the antenna 54. For an exemplary low-UHF implementation, an angle θ of 20 degrees has been demonstrated to improve performance of a single-slot 3.5 inch diameter antenna compared to an all-orthogonal configuration in an otherwise similar antenna.

As in all high-voltage RF apparatus, individual elements of the exemplary embodiment 54 can preferably be rounded and free of burrs and rough surfaces, particularly on exposed edges, to avoid voltage gradients that could promote arcing.

Figure 7:
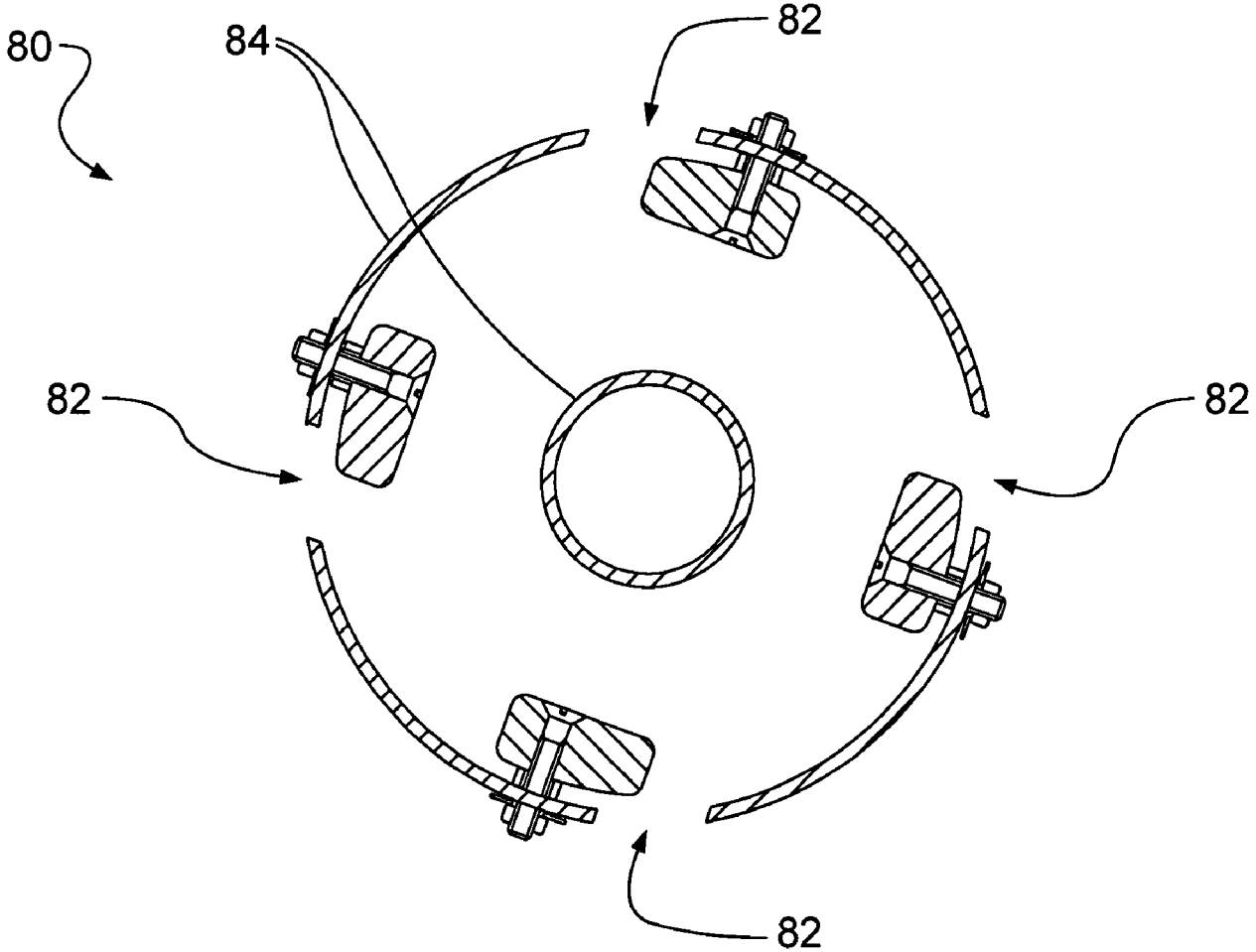
FIG. 7 is a section view of an exemplary slotted coaxial line antenna incorporating a multiplicity of radially distributed slots according to a preferred embodiment of the invention.

FIG. 7 shows a cross section view of an exemplary slot antenna 80 having four slot radiators 82 uniformly distributed around a coax 84. Slot antennas shown thus far depict a single slot piercing the outer conductor of a coax, with the slot antenna formed thereby radiating a single lobe in the direction in which the slot opens and has a low-level signal in all other directions, which is known in the art as a skull radiation pattern. Two slots on opposite sides of the coax can produce opposed twin lobes in a so-called peanut radiation pattern, while three equally spaced slots will typically produce a three-lobed radiation pattern.

With four or more slots 82 having angled wall surfaces and placed at uniform intervals around the coax 84, a substantially uniform circular pattern can be achieved. The features of this invention can be used to produce each of the above-described patterns, generally with measurably greater efficiency than in prior-art slotted coax antennas, as described, for example, in FIGS. 3, 4, and 5. Additionally, the exemplary embodiments of this invention do not suffer from deterioration over time as in prior-art slotted coax designs that rely on slot lengtheners 48 or dielectric inserts 52 to enhance performance.

Experiments have shown that a slot antenna having two or three slots incorporating the features of this invention will generate patterns with prominent lobes. Analysis suggests that by increasing the number of slots, an effectively omnidirectional radiation pattern can be generated. In building a directional antenna from slotted coax, minimizing coax diameter may be a preferable strategy, while in building an omni antenna, it may be preferable in at least some instances to use a larger diameter coax with multiple slots as in FIG. 7 rather than a multiplicity of smaller, radially positioned single-slot antennas.

Figure 8:
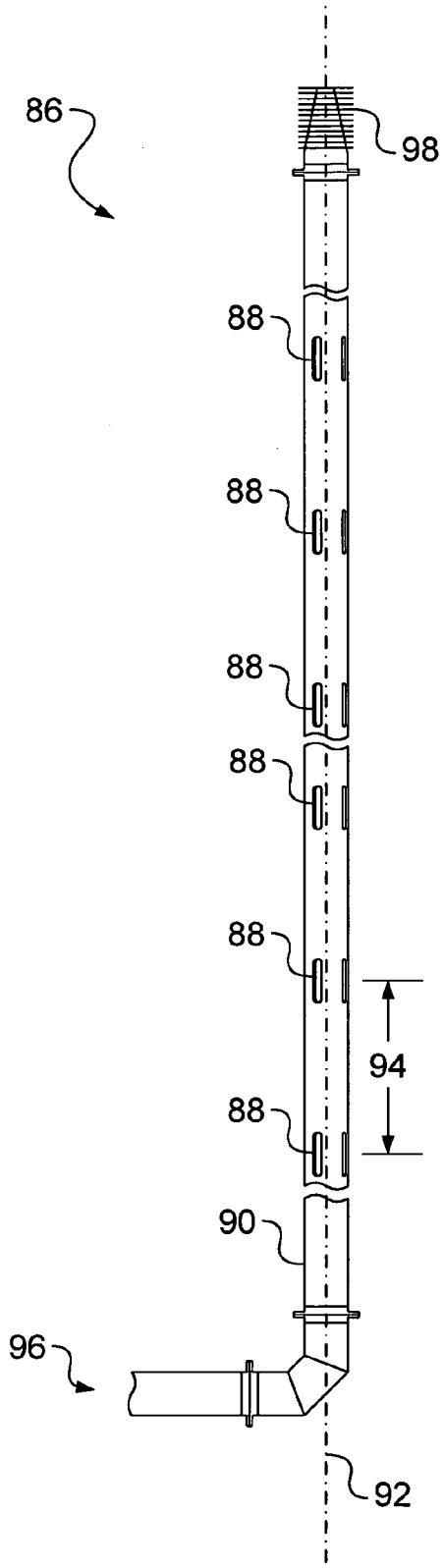
FIG. 8 is a side view of an exemplary slotted coaxial line antenna incorporating a multiplicity of linearly distributed radial arrays of slots according to a preferred embodiment of the invention.

FIG. 8 illustrates a side view of an exemplary slot coaxial line antenna 86 featuring a vertical array of slot radiators 88. A single slot 62 in FIG. 6 or a single radial array of slots 82 in FIG. 7 distributed around a vertically oriented coax 90 can produce a propagating wave that is horizontally polarized and whose pattern is distributed above and below the horizontal much as a dipole in free space is distributed. That is, the signal strength is greatest at the horizon and decreases with angle toward the zenith and nadir. Since a typical broadcast application may have little need for signal strength significantly above and below the horizon, it can be advantageous to position a multiplicity of elements, where each element is a slot or radial array of slots 82, in a vertical array 88. The signals emitted from a vertical array 88 so configured can constructively interfere in azimuth with respect to the coax's longitudinal axis 92, and destructively interfere in elevation. An exemplary slot antenna 88 can typically have from about four elements to some forty or more depending on the directivity required.

Spacing the elements of a slot coaxial line antenna 86 uniformly at approximately one wavelength intervals 94 along the coaxial line 90 produces a beam arraying effect which reinforces the signals to be vertically centered near the midpoint of the slot array 88, if fed from one end 96 and terminated at the other end 98. Such an antenna 86 may depend for its performance on matching between the slot-to-slot spacing 94 and the center frequency of the signal for which the antenna 86 is to be used. By spacing the elements uniformly closer, for a bottom-fed antenna 86, the antenna pattern can be tilted downward. Similarly, spacing the elements uniformly further apart, for a bottom fed antenna 86, produces an antenna pattern tilted upward. Of course, upward and downward are relative terms, depending on the positioning of the feed in the antenna 86.

For broadcasting purposes, due to propagation delay from the first slot to the last slot, an end-fed slot coaxial line antenna 86 may to some extent reduce the time precision with which a signal can be detected by a receiver, but nonetheless produce acceptable results for such applications as high-quality video and audio reception. For higher data density communications or other applications where increased time precision of a received broadcast signal is desirable, an array design that reduces the time delay from the first to the last radiator may be preferable. Such a design may comprise a multiplicity of slotted shorter coaxial sections driven in parallel from a splitter or from a center-driven coax, or may be of another style according to design preference.

The exemplary antennas described herein may require a matched end load termination 96 on each coaxial line 90, such as that shown in FIG. 8. Since the exemplary couplers 60 shown in FIG. 6 represent a number of impedance lumps when used, for example, in the exemplary embodiment of FIG. 8, it may be necessary to adjust the characteristics of the load termination 96 to prevent reflections. A shorted or open termination may be possible for some designs.

Although the exemplary embodiments are shown using a planar, oblique slot 62 and a noncylindrical coupler 60 with at least one planar face 78, such as shown in FIG. 6, it will be appreciated that other implementation strategies can be used for the various exemplary embodiments described herein. Also, although the exemplary embodiment increases coupling efficiency when used in a slotted-coax low UHF television broadcast antenna, it can also be used in other frequency bands and for other communications and radiative purposes. For example, smaller coaxes, supporting higher frequency bands at reduced power levels, can be used for business communications. Devices including the features of the invention can likewise be used for heating in industrial processes, for RF excitation of particles, and for other non-communications-oriented purposes.

It should be appreciated that, while the various exemplary embodiments describe an oblique slot design for use with coaxial line, it is evident that the concept can be applied to waveguide systems or non-coaxial line systems as well.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, that fall within the scope of the invention.

What is claimed is:

1. A slotted coaxial antenna, comprising:

a coaxial line comprising a longitudinal axis of symmetry, wherein said coaxial line further comprises an outer conductor and an inner conductor, wherein said outer conductor comprises a longitudinally oriented first slot, said coaxial line having a radiation plane perpendicular to the axis at a longitudinal midpoint of said first slot;

a surface of a first longitudinal edge of said first slot substantially oblique to a first radial projection, lying in the radiation plane, from the axis; and a slot coupler positioned proximally interior to said first slot.

2. The slotted coaxial antenna of claim 1, further comprising: a surface of a second longitudinal edge of said first slot, wherein said surface is substantially oblique to the first radial projection.

3. The slotted coaxial antenna of claim 2, wherein the surfaces of the first longitudinal edge and the second longitudinal edge of said first slot are parallel.

4. The slotted coaxial antenna of claim 3, further comprising:

a second slot in said coaxial line, positioned substantially equidistant with said first slot from the input port, in which second slot a surface of a first longitudinal edge of the second slot is substantially oblique to a second radial projection from a radial center of said coaxial line; and a second slot coupler positioned proximally to said second slot.

5. The slotted coaxial antenna of claim 4, further comprising: a surface of a second longitudinal edge of the second slot, wherein said surface is substantially oblique to the second radial projection.

6. The slotted coaxial antenna of claim 5, wherein the surfaces of the first longitudinal edge and the second longitudinal edge of the second slot are parallel.

7. The slotted coaxial antenna of claim 3, further comprising:

a circumferential array comprising a plurality of slots in said coaxial line, positioned equidistant with said first slot from an input port, in which plurality of slots an equal number of planar regions of said plurality of slots are situated obliquely to an equal number of radial projections from said longitudinal axis of said coaxial line projected through the respective centers of said plurality of slots; and a plurality of couplers positioned proximally to said plurality of slots.

8. The slotted coaxial antenna of claim 7, further comprising: a longitudinal array of circumferential arrays of slots in said coaxial line, said circumferential arrays being positioned at uniform intervals along said coaxial line.

9. The slotted coaxial antenna of claim 8, wherein said circumferential arrays of slots are positioned with a uniform spacing equal to the wavelength of the center frequency of the channel for which the antenna is to be used.

10. The slotted coaxial antenna of claim 8, wherein said circumferential arrays of slots are positioned with a uniform spacing that differs from that of the wavelength of the center frequency of the channel for which the antenna is to be used in proportion to the amount of beam tilt required of the antenna.

11. The slotted coaxial antenna of claim 8, wherein said slots are positioned with a uniform spacing that differs from that of the wavelength of the center frequency of the channel for which the antenna is to be used in proportion to the amount of beam tilt required of the antenna.

12. The slotted coaxial antenna of claim 3, further comprising:

a longitudinal array comprising a plurality of slots in said coaxial line, positioned at uniform intervals along said coaxial line, in which plurality of slots an equal number of planar regions of said plurality of slots are situated obliquely to an equal number radial projections from said longitudinal axis of said coaxial signal line projected through the respective centers of said plurality of slots; and a plurality of couplers positioned proximally to said plurality of slots.

13. The slotted coaxial antenna of claim 12, wherein said slots are positioned with a uniform spacing equal to the wavelength of the center frequency of the channel for which the antenna is to be used.

14. The slotted coaxial antenna of claim 12, wherein said slots are positioned with a uniform spacing that differs from that of the wavelength of the center frequency of the channel for which the antenna is to be used in proportion to the amount of beam tilt required of the antenna.

15. The slotted coaxial antenna of claim 3, wherein said first slot has a length in a direction parallel to the longitudinal axis of said coaxial line that is inversely proportional to an inner diameter of said outer conductor of said coaxial line section.

16. The slotted coaxial antenna of claim 2, wherein said slot coupler has a first substantially planar region of said slot coupler that is oriented substantially parallel to and separated from said surface of the second longitudinal edge.

17. The slotted coaxial antenna of claim 1, further comprising: an input port located at one end of said antenna, wherein said input port is capable of accepting radio frequency electromagnetic signals.

18. The slotted coaxial antenna of claim 17, further comprising: an output port located distal to said input port, wherefrom said output port is capable of passing such radio frequency electromagnetic signals as are not emitted by said antenna.

19. The slotted coaxial antenna of claim 17, further comprising: a termination load located distal to said input port.

20. The slotted coaxial antenna of claim 17, wherein said slot coupler is capable of causing a portion of a radio frequency electromagnetic signal propagating within said coaxial line to be emitted from said first slot.

21. The slotted coaxial antenna of claim 1, wherein said slot coupler is bonded electrically and mechanically to said outer conductor.

22. The slotted coaxial antenna of claim 1, wherein said slot coupler is positioned immediately adjacent to the first longitudinal edge of said first slot.

23. The slotted coaxial antenna of claim 1, wherein said slot coupler is positioned to intrude into a void of said first slot.

24. The slotted coaxial antenna of claim 1, wherein external surfaces of said slot coupler are rounded.

25. A slotted coaxial antenna, comprising:

conducting means for conducting a radio frequency electromagnetic signal, said conducting means having a first longitudinal axis;

confining means for confining the conducted radio frequency electromagnetic signal within a closed, electrically conductive boundary, the boundary having a second longitudinal axis generally coincident with the first longitudinal axis;

allowing means for allowing a portion of the conducted radio frequency electromagnetic signal to be emitted from within the closed, electrically conductive boundary;

coupling means for coupling the allowed portion of the radio frequency electromagnetic signal into a condition for emission; and directing means for directing the allowed portion of the radio frequency electromagnetic signal, wherein a maximum emitted signal intensity lies generally within a plane perpendicular to the first longitudinal axis, wherein said directing means has a principal angle that is oblique with respect to a radial line intersecting the first longitudinal axis within the plane, and intersecting a midpoint of said allowing means.

26. The slotted coaxial antenna of claim 25, wherein a plurality of allowing means allow a plurality of emitted portions of the radio frequency electromagnetic signal to reinforce a signal strength of the emitted signal at right angles to the axis of said plurality of allowing means and to attenuate the signal strength of the emitted signal parallel to the axis of said plurality of allowing means.

27. A process for emitting radio frequency electromagnetic signals comprising the steps of:

conducting a radio frequency electromagnetic signal along a path having a first longitudinal axis;

confining the conducted radio frequency electromagnetic signal within a closed, electrically conductive boundary, wherein the boundary has a second longitudinal axis generally coincident with the first longitudinal axis;

allowing a portion of the radio frequency electromagnetic signal to be emitted from within the closed, electrically conductive boundary;

coupling the allowed portion of the radio frequency electromagnetic signal into a condition for emission; and directing the allowed portion of the radio frequency electromagnetic signal, wherein a vector of maximum emitted signal intensity lies generally within a plane perpendicular to the first longitudinal axis, wherein a principal angle of directing is oblique with respect to a radial line within the perpendicular plane intersecting the first longitudinal axis, and intersecting a directing midpoint.

* * * * *